US005841059A

United States Patent [19]

Laurend et al.

[11] Patent Number: 5,841,059

[45] Date of Patent: Nov. 24, 1998

[54] PROJECTILE WITH AN EXPLOSIVE LOAD TRIGGERED BY A TARGET-SIGHTING DEVICE

[75] Inventors: Pascal Laurend, Ligny le Ribault; Jean-Noël Bilbaut, Saint Doulchard, both of France

[73] Assignee: Luchaire Defense S.A., France

[21] Appl. No.: 826,593

[22] Filed: Apr. 3, 1997

[30] Foreign Application Priority Data

Apr. 5, 1996 [FR] France ..... 96 04365
Apr. 5, 1996 [FR] France ..... 96 04366

[51] Int. Cl.[6] ..... F42C 13/02; F42C 9/14; F42B 10/00; F41G 7/00

[52] U.S. Cl. ..... 102/213; 102/211; 102/476; 102/265; 102/270; 244/3.14

[58] Field of Search ..... 102/211, 213, 102/475, 476, 489, 387, 389, 393, 396, 385, 386, 384, 265, 270; 244/3.14, 3.16, 3.19

[56] References Cited

U.S. PATENT DOCUMENTS

| | | | |
|---|---|---|---|
| 2,966,316 | 12/1960 | Ward et al. | 244/3.14 |
| 3,698,811 | 10/1972 | Weil | 244/3.14 |
| 4,026,215 | 5/1977 | Ziemba et al. | 102/265 |
| 4,050,381 | 9/1977 | Heinemann . | |
| 4,143,835 | 3/1979 | Jennings, Jr. et al. | 244/3.16 |
| 4,242,962 | 1/1981 | Wakeman et al. | 102/213 |
| 4,291,627 | 9/1981 | Ziemba et al. | 102/211 |
| 4,333,008 | 6/1982 | Misek | 244/3.16 |
| 4,347,996 | 9/1982 | Grosso | 244/3.16 |
| 4,407,465 | 10/1983 | Meyerhoff | 244/3.16 |
| 4,538,519 | 9/1985 | Witt et al. | 102/475 |
| 4,587,902 | 5/1986 | Lindner et al. | 102/213 |
| 4,612,859 | 9/1986 | Furch et al. | 102/476 |
| 4,711,178 | 12/1987 | Argyrakis et al. | 102/387 |
| 4,773,328 | 9/1988 | Germershausen et al. | 102/211 |
| 4,831,935 | 5/1989 | Sundermeyer | 102/476 |
| 4,858,532 | 8/1989 | Persson et al. | 102/211 |
| 4,878,433 | 11/1989 | Pirolli | 102/387 |
| 5,003,885 | 4/1991 | Rudolf et al. | 102/475 |
| 5,050,476 | 9/1991 | McKnight et al. | 244/3.16 |
| 5,111,748 | 5/1992 | Thurner | 102/387 |
| 5,196,644 | 3/1993 | Knight et al. | 102/213 |
| 5,339,742 | 8/1994 | Hulderman et al. . | |
| 5,341,743 | 8/1994 | Redaud | 102/476 |
| 5,526,749 | 6/1996 | Teetzel | 102/213 |

FOREIGN PATENT DOCUMENTS 4108057 9/1992 Germany .

OTHER PUBLICATIONS

Definition of "evince"; Webster's II New Riverside University Dictionary, p. 448, Jan. 1994.

*Primary Examiner*—Charles T. Jordan
*Assistant Examiner*—Theresa M. Wesson
*Attorney, Agent, or Firm*—Parkhurst & Wendel, L.L.P.

[57] ABSTRACT

The invention concerns projectiles having an explosive load generating splinter and/or a core and of which the operation is triggered by a fuse. This projectile is characterized in that the load comprises at least one direction of action and in that the fuse comprises at least one detector detecting laser radiation reflected by a target, said detector comprising a direction of detection which is close to one of the directions of action of the load.

19 Claims, 8 Drawing Sheets

PROJECTILE WITH AN EXPLOSIVE LOAD TRIGGERED BY A TARGET-SIGHTING DEVICE

The invention concerns projectiles having an explosive load triggered by a fuse.

Bursting explosive projectiles are known (for instance conventional artillery shells). Most of the time such projectiles are ignited by an impact fuse or by a proximity fuse sensing approach to ground.

Such projectiles are intended to attack light vehicles or are used in antipersonnel combat. They suffer from limited effectiveness because of the wide scattering both of the projectiles and their splinters. Accordingly consumption of projectiles is high and logistics and costs also are high.

Moreover such projectiles cannot be accurately used in an urban environment: in general they make use of a fuse sensing not the target but the ground.

Such projectiles cannot be reliably and economically refitted by equipping them with target sensors:

The known target detectors use radar or infrared (IR) detectors.

Such detectors are expensive and can only be used to attack targets of which the radar or IR signature is large or known. Therefore they are used only as antitank weapons.

Semi-autonomous projectiles (such as the US Copperhead missile) are known of which the terminal guidance is made possible by laser-sighting the target, such sighting being implemented by a forward observer.

Such projectiles also are very expensive because of the complexity in guidance and control.

Furthermore antitank projectiles are known which scatter several sub-projectiles with core-generating loads above a terrain within which targets are present.

In general the employed sub-projectiles are fitted with radar or IR target-detectors. They comprise a computer carrying out complex algorithms implementing target recognition.

Such projectiles are very expensive and are used only for attacking targets having a large and well known radar or IR signature.

Nevertheless their efficacy will be lowered when the targets are camouflaged or at rest (reduced IR signature).

Said projectiles also may lose efficacy in that two different sub-projectiles may attack the same target.

The object of the invention is to create a projectile having a load generating splinter and/or a core free of such drawbacks.

Thus the projectile of the invention is low-cost because using simple detection means and not requiring guidance/steering means.

The projectile of the invention makes possible accurately attacking light targets.

Furthermore the invention allows accurately attacking camouflaged targets or targets equipped with deception means, both in open and in urban environments. Accordingly it permits a surgical strike on the targets while minimizing collateral damage.

In a number of variations, the projectile of the invention may be specified to be antitank or anti-personnel or being selectively in the antitank or anti-personnel modes.

Therefore the object of the invention is a projectile having at least one explosive load generating splinters and/or a core and triggered by a fuse, which is characterized in that the load evinces at least one direction of action and in that the fuse comprises at least one detector of laser radiation reflected by a target and arriving from a sighting device placed on the terrain, said detector evincing a direction of detection which is close to that of the load's direction of action, said projectile being made to rotate to allow the directions of detection and action to sweep a terrain segment, detection of laser radiation reflected by a target igniting the load.

Advantageously the fuse comprises a decoder for a signal transmitted by the laser radiation reflected by the target.

The projectile may comprise a transmitting means to control the activation of a laser sighting device located on the terrain.

In another embodiment the load comprises at least two different operational modes that can be selectively initiated by the fuse.

Advantageously the fuse decoder is able to determine the desired operational mode based on a signal carried by the laser radiation reflected from the target.

In another embodiment, the load evinces at least two different directions of action and at least two different directions of detection associated with said directions of action.

In a particular embodiment, the load is a core-generating load.

The projectile may be a sub-projectile dropped by a carrier above a terrain segment, further it may also be a ballistic projectile such as an artillery shell or a mortar shell, or it may be a projectile jettisoned from an aircraft and follow a free-gliding path or a free-fall path.

Lastly the projectile of the invention may be a straight-line projectile fired by a tank gun or by a light rocket launcher.

Other advantages of the invention are elucidated in the following description of different embodiments and in relation to the attached drawings.

FIGS. 1*a*, 1*b* diagrammatically show the actuation over terrain of a projectile of the invention.

Figure 1A:
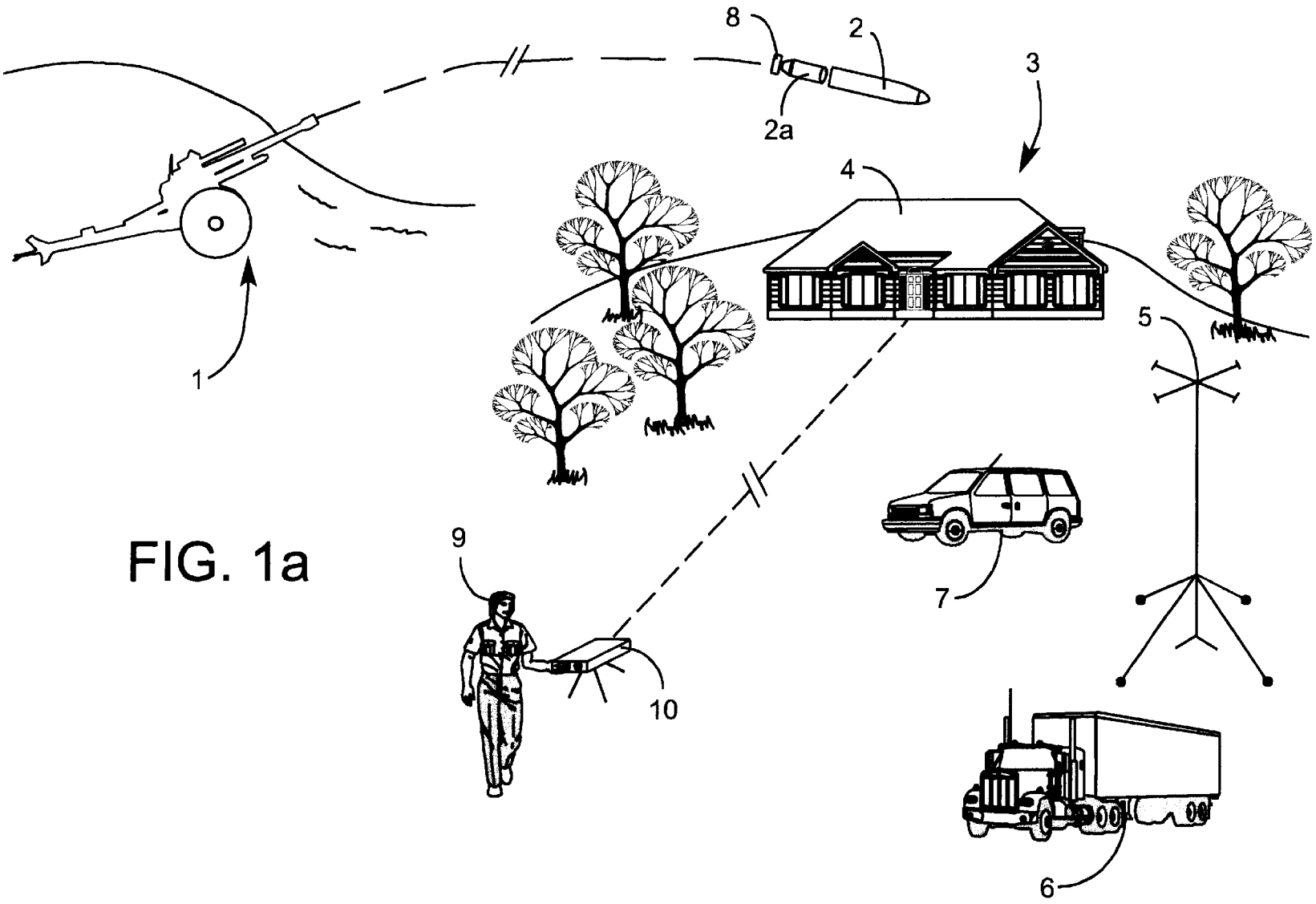
Figure 1B:
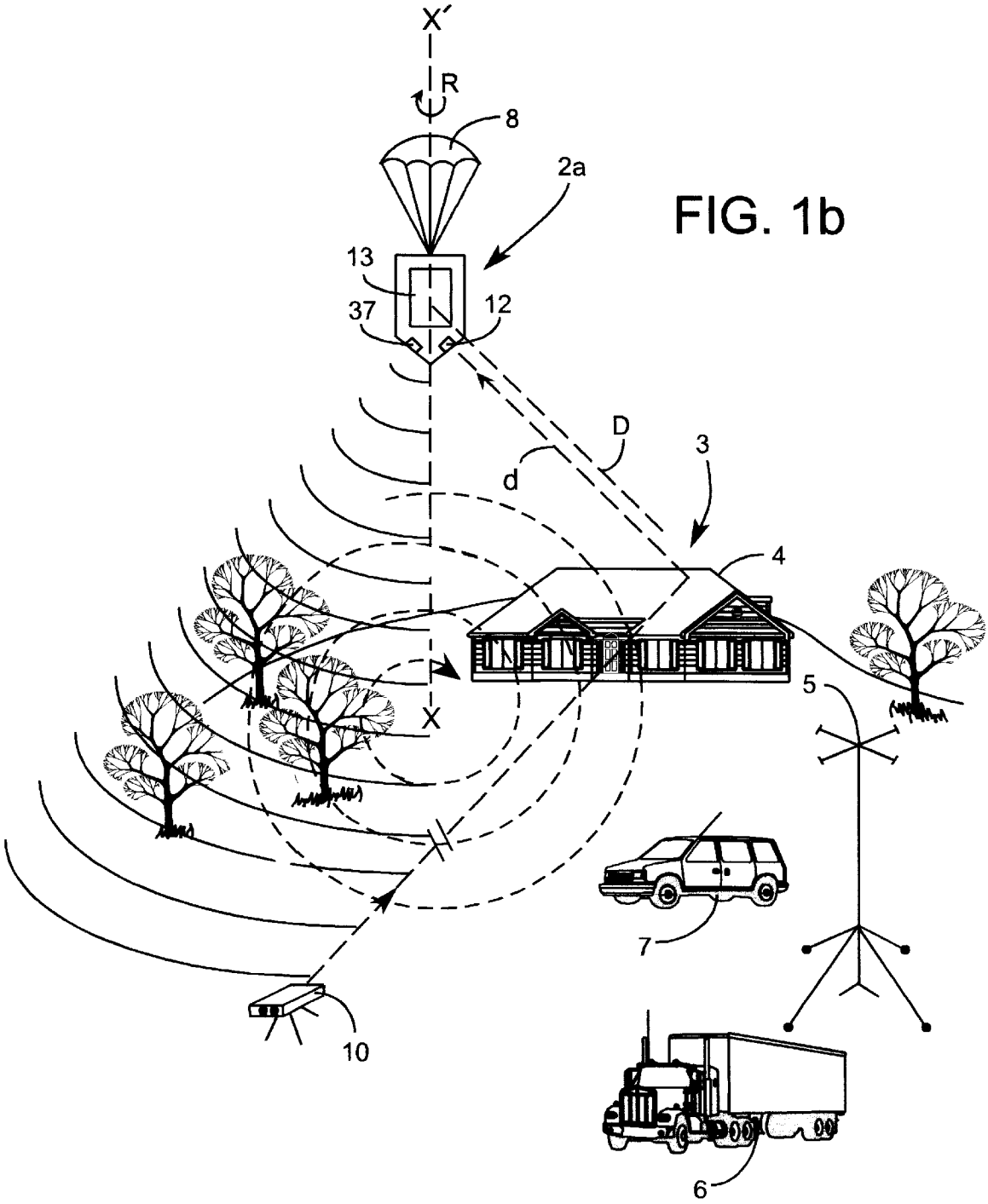

As shown in FIGS. 1*a* and 1*b*, a weapon 1 such as a howitzer fires a projectile 2 of the invention in the direction of a objective 3 which in this instance is a command post.

A command post involves several targets which are only slightly protected but of high tactical importance such as a shelter 4, transmitter(s) 5, and light vehicles 6, 7.

Said targets usually are camouflaged and emit only low IR signatures and cannot be attacked by known projectiles.

The projectile 2 of the invention is a carrier projectile which will eject a sub-projectile 2*a* above the objective 3.

Ejection is carried out in known manner using a timer fuse before firing.

The sub-projectile 2*a* is decelerated by deploying a parachute 8 which furthermore imparts to it a substantially vertical orientation XX' relative to the objective 3. A rotational speed of roughly 15 revolutions a second about said axis XX' is imparted to the sub-projectile (residual speed imparted by the carrier projectile 2).

An advance observer 9 is a distance approximately 1 to 2 km from the objective 3. He is equipped with a laser sighting device 10 to beam the laser 11 at a selected target 4.

The target 4 reflects part of the laser beam to the sub-projectile 2*a*.

Said sub-projectile 2*a* is equipped with a directional laser-radiation detector 12 (such as a photodiode) evincing an observational direction d close to the direction of action D of an explosive load 13 of the sub-projectile 2*a*.

Because the sub-projectile is rotating while descending, the direction of observation d (as well as the direction of action D) sweep the ground in a spiral.

Upon the detector 12 receiving the radiation reflected by the target 4, it ignites the load 13 which shall be maximally effective because of the orientation of its direction of action D toward the target 4.

Figure 2:
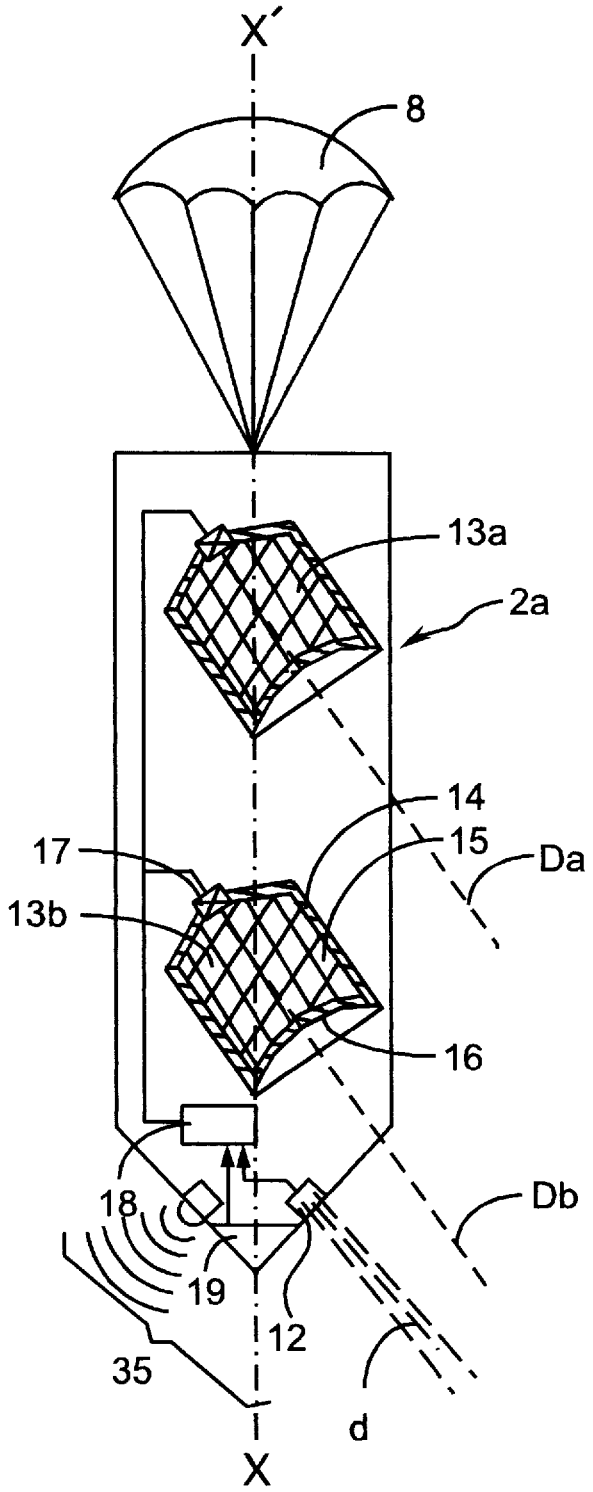
FIG. 2 is a longitudinal section of a projectile of a first embodiment of the invention.

FIG. 2 shows a first embodiment of such a sub-projectile.

The embodiment of FIG. 2 comprises two splinter-generating loads 13*a*, 13*b* each having a direction of action Da, Db parallel to the direction of observation d of the detector 12.

Each splinter-generating load 13*a*, 13*b* comprises in known manner a case 14 enclosing an explosive 15 and sealed by an embrittled cladding 16, said weakening illustratively being implemented by electron bombardment along a grid.

When igniting such a load, the shockwave imparted by the explosive to the cladding causes cladding bursting and splinter projection.

The curvature imparted to the cladding allows focusing the splinter shower in the direction of action Da, Db which is also the axis of symmetry of the cladding and of the load.

Preferably the cladding shall be a high-density material such as tantalum or steel.

Each explosive load 15 is ignited by a primer detonator 17.

The fuse system of the sub-projectile 2*a* comprises a detector 12 of which the direction of observation d is substantially parallel to the directions of action Da, Db. Said fuse also comprises a computer 18 and an altimeter 19 which may be a radar altimeter.

The altimeter 19 precludes igniting the explosive loads when the distance from the sub-projectile and the ground is excessively large. Therefore the signals received at the detector 12 are only considered if the sub-projectile is sufficiently close to the ground for the effectiveness of the splinter loads to be maximum.

Such a design also allows protecting the sub-projectile against countermeasure deceptions.

The computer 18 receives the signals transmitted by the detector 12 and implements the ignitions of the loads when a laser beam is reflected toward it by the sighted target (provided the altimeter allows).

Advantageously coding transmitted by the sighting laser 10 and carried by the beam, for instance phase or frequency modulation of the beam, may be provided. Such coding is received by the detector 12 together with the signal reflected by the target and is detected by the computer-decoder 18 which in this instance decodes the modulated beam to allow firing the loads only in the presence of the code.

In this manner the safety of the sub-projectile to any countermeasures from the target, such as laser sources directed at the sub-projectile, will be enhanced.

The characteristics of the sighting laser, in particular its power and its transmitting frequency depend on the angular speed of the sub-projectile, the altitude at which firing may be initiated and the slopes of the directions d and D relative to the vertical.

These parameters are easily determined by the expert as a function of operational requirements.

Illustratively a sighting device operating at roughly 20 kHz may be used, in association with a sub-projectile rotating a speed of 15 rev/s and descending at a rate of 50 m/s. The slopes of the directions d and D relative to the vertical resp. then are 40° and 41°.

In general ignition of such a splinter load shall be triggered at a distance of about 150 to 200 m from the target.

The directions d and D are not mandatorily parallel. In practice these two directions are close to each other and subtend an angle which is function of the descent rate of the projectile and of the splinter speeds (this angle is about 1°). The slope D of the splinter load will be slightly larger relative to the vertical than the slope d: combining the splinter speeds with the rate of descent then assures that the splinter shower shall impact near the detected point.

Advantageously the sub-projectile is equipped with a delayed pyrotechnic or electronic self-destruct feature or with a fuse triggering ignition following ground impact of the sub-projectile. In such a design destruction of the sub-projectile having found no target will be assured.

Figure 4:
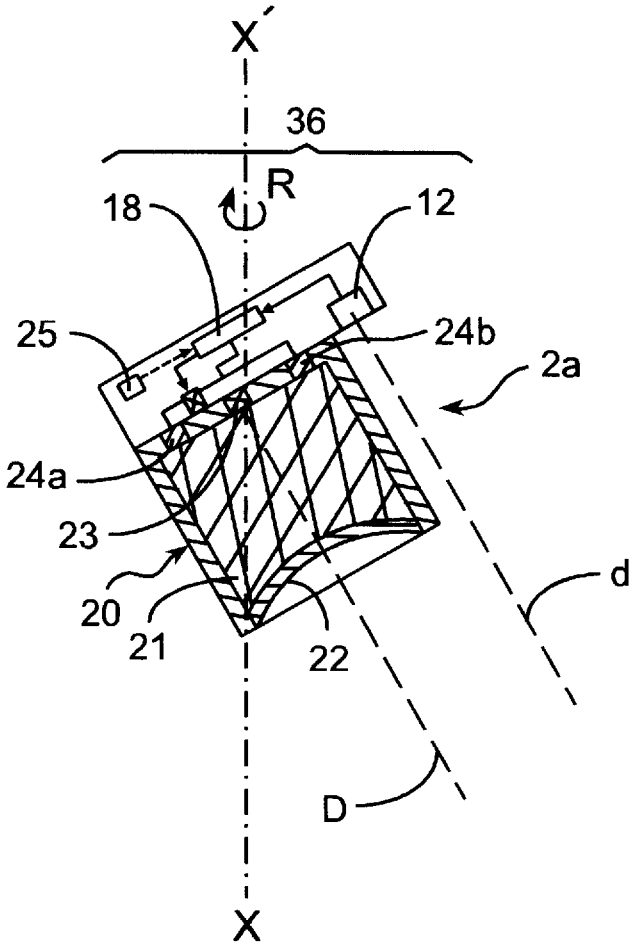
FIG. 4 shows a projectile of a second embodiment of the invention.

It is furthermore quite feasible in a variation of the invention to design a simpler fuse system 36 of the sub-projectile without an altimeter. Such an altimeter as shown in FIG. 4 may be replaced by transmitting on the beam an additional code relating to altitude measured by a known means on the ground and omitted from the drawings. The additional code may be an enabling firing signal that shall be transmitted by the sighting operator only when the sub-projectile has reached the proper altitude.

Moreover a larger or lesser number of splinter loads may be fitted into the sub-projectile.

Regarding the shell carrier 2, the timer fuse may be replaced by a radio-equipped fuse that shall receive a command to eject the sub-projectile transmitted by the advanced observer.

In a variation, it is possible also to equip the sub-projectile 2*a* with a radio transmitter 37 to control remotely the transmission of the sighting beam of the sighting laser 10 as shown in FIGS. 1*b* and 2 for the purpose of limiting exposure of the observer 9. The Transmitter 37 received a signal to transmit from the computer-decoder 18, as shown in FIG. 2. The computer-decoder may provide actuation of the transmitter 37 based upon information provided by the altimeter 19, or actuation of the transmission may begin after a predetermined amount of time has elapsed after firing.

In this case the target-sighting duration can be much reduced and as a result detection by the target as well as counter-strikes will be restricted. The sighting means also might remain alone on the terrain, remaining pointed at the target selected by the observer.

Figure 3:
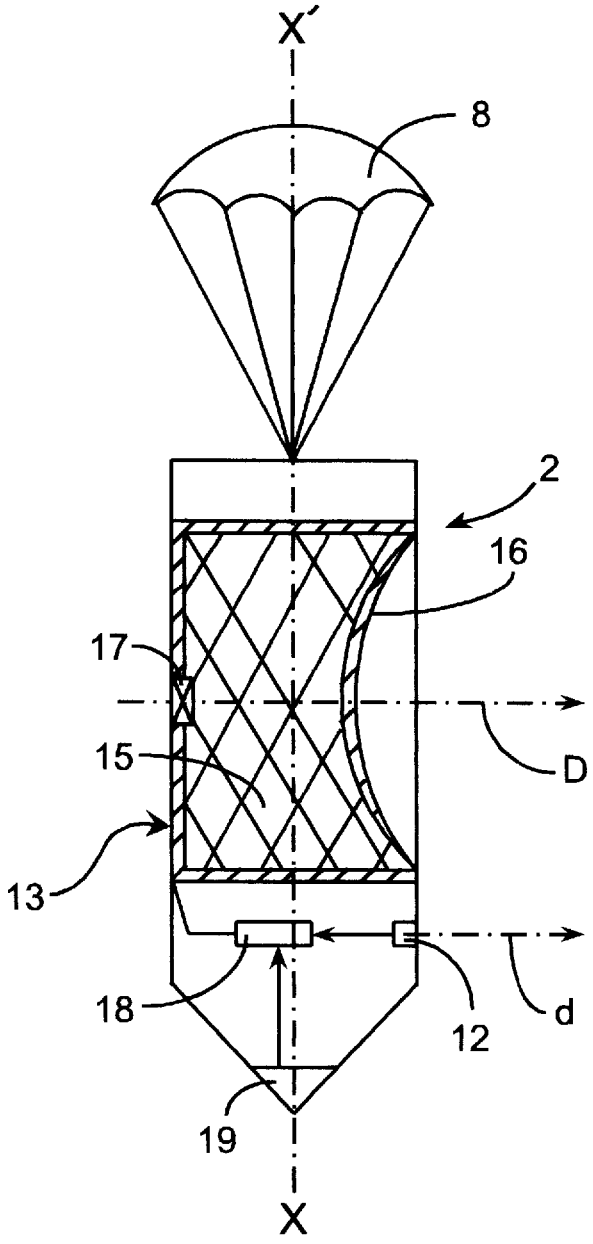
FIG. 3 is a variation of the embodiment of FIG. 2.

FIG. 3 shows a variation of the sub-projectile 2*a* containing a single splinter-generating load 13 of which the direction of action D is radial relative to the sub-projectile, hence substantially horizontal.

The direction of detection d also is radial.

In this case the load also comprises an explosive 15 and an embrittled cladding 16. This sub-projectile also is equipped with an altimeter 19.

This variation is more particularly designed to attack light aircraft such as helicopters, whether on the ground or in flight or to attack sideways small targets such as vehicles, shelter doors.

A load of the invention may be designed for at least two different operational modes, namely with splinters load and with antitank load.

FIG. 4 shows a sub-projectile of which the load 20 comprises an explosive charge 21 within a case and to which a cladding 22 is applied.

The load 20 can be ignited by an axially mounted primer detonator 23 or by the simultaneous ignition of one or more primers 24*a*, 24*b*, 24*c* . . . (optionally of different powers) and at least one primer 24*a* being mounted some distance from the load axis D.

When the load is ignited by the primer 23, the detonation wave propagating in the explosive charge is perfectly symmetrically about the axis D and transforms the cladding 22 into a high-speed core (2,000 to 2,500 m/s). In this case the load functions like an antitank load (core generating load).

When the load is ignited by the primers 24, the generated detonation waves cause the cladding to fragment into splinter as described in the German patent 3,625,967. In this instance the load functions as a load against light vehicles, or against personnel or aircraft.

Accordingly the load 20 offers two distinct operational modes both in the same direction of action D.

The load direction of action D slopes relative to the vertical XX' and the sub-projectile is rotating at a speed R about the axis XX'. This rotation is the residual rotation imparted to the sub-projectile by the projectile carrier 2. Said rotation also may be imparted by a stabilizing parachute as disclosed in the French patent 2,679,643 or by any other stabilizing means such as those described in the European patent document 587,970 or in U.S. Pat. No. 4,858,532. The stabilizing and/or decelerating means are omitted from the Figures. Details concerning stabilizing means and aerodynamic deceleration in particular may be found in the French patent 2,590,663, U.S. Pat. No. 4,807,533, European patent document 587,970, U.S. Pat. No. 4,858,532 and French patent 2,679,643.

The sub-projectile of the invention is fitted with an exceedingly simple processing electronics.

As was the case for the preceding embodiment, the detector 12 detects the laser beam transmitted by the sighting device and reflected by the sighted target. The beam is coded to hamper countermeasures against the sub-projectile. The computer-decoder 18 initiates firing the load 21 when the detector 12 receives the code reflected by the target.

As in the preceding embodiment, the sub-projectile may be equipped with an altimeter precluding load ignition when the distance to ground is excessively large.

The target sighting device transmits a laser beam which in addition to the anti-countermeasure code also carries information about the desired mode of operation, namely the load being used as core-generator or splinter generator.

The detector 12 transmits the signal reflected by the target to the computer-decoder 18 which winnows (for instance by filtering) the operational-mode information carried by the signal and, depending on the case, triggers the primer 23 or the primer 24.

This design makes it possible for the foot soldier sighting the target to select at the last moment the desired mode of operation while using the same sub-projectile.

In a variation, a memory 25 may be connected to the computer to store therein the desired load operational mode by means of the weapon system prior to firing or else being rf transmitted by the forward observer at the time the sub-projectile is ejected, in which latter case the memory is connected to a radio receiver and to an electronic decoder.

Figure 5:
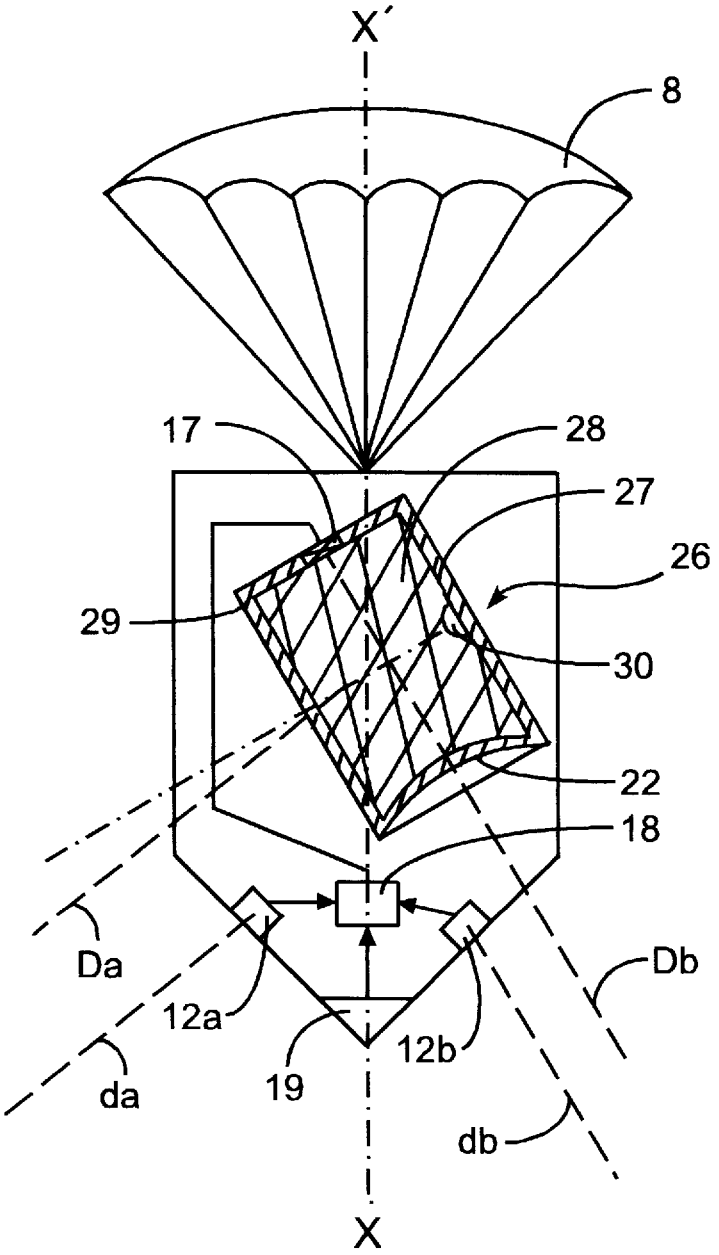
FIG. 5 shows a projectile of a third embodiment of the invention.

FIG. 5 shows a third embodiment of the invention wherein the load 26 evinces two operational modes each with a different direction of action Da, Db.

Figure 6:
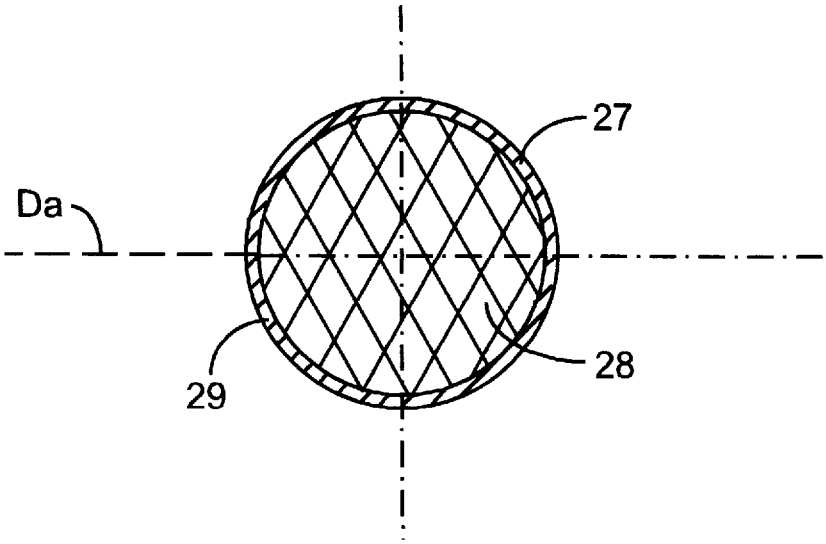
FIG. 6 is a cross-section of the load of the projectile of FIG. 5.

The case 27 of this load contains an explosive 28 and was locally embrittled in the vicinity of a cylindrical sector 29—see the load cross-section in FIG. 6.

Said case is closed at one of its ends by a heavy-material cladding such as iron or tantalum that shall form a core.

A single primer 17 ignites this load which simultaneously launches a core in the direction of action Db and a splinter shower in the direction Da.

The sub-projectile 2*a* is fitted with two detectors 12*a*, 12*b*. The direction of detection da of the detector 12*a* is close to the direction of action Da, and the direction of detection db of the detector 12*b* is close to the direction of action Db.

Again the target sighting device transmits by means of the laser beam a code to the sub-projectile allowing sub-projectile's determination of operational-mode priority, namely splinter load or core-generating load.

Thereupon the computer ignites the load 26 at the time the detector associated with the direction of action corresponding to the selected mode of operation receives the target-reflected signal and provided altimeter 19 allows firing.

In this manner, if a light target was sighted, the load shall be triggered only by the detector 12*a* detecting the sighting beam. In that case the efficacy of the splinter load will be maximum with respect to the target.

If on the other hand the sighted target is a tank, the load is triggered only by the detector 12*b* detecting the sighting beam. In that instance the efficacy of core-generating load will be maximum with respect to the target.

It is possible, in a variation, to replace the cladding 22 with an embrittled cladding also generating splinter. In such a case the splinter load 26 comprises two priority directions of action against light vehicles.

Again it is possible, for instance in order to improve the splinter shower formed by the sector 29, to install two different primers which may be ignited by the computer 18.

The primer 17 then will be ignited to fire the core-generating load and another primer 30 mounted in a median plane of the load and opposite the sector 29 will be ignited to fire the splinter load.

Figure 7:
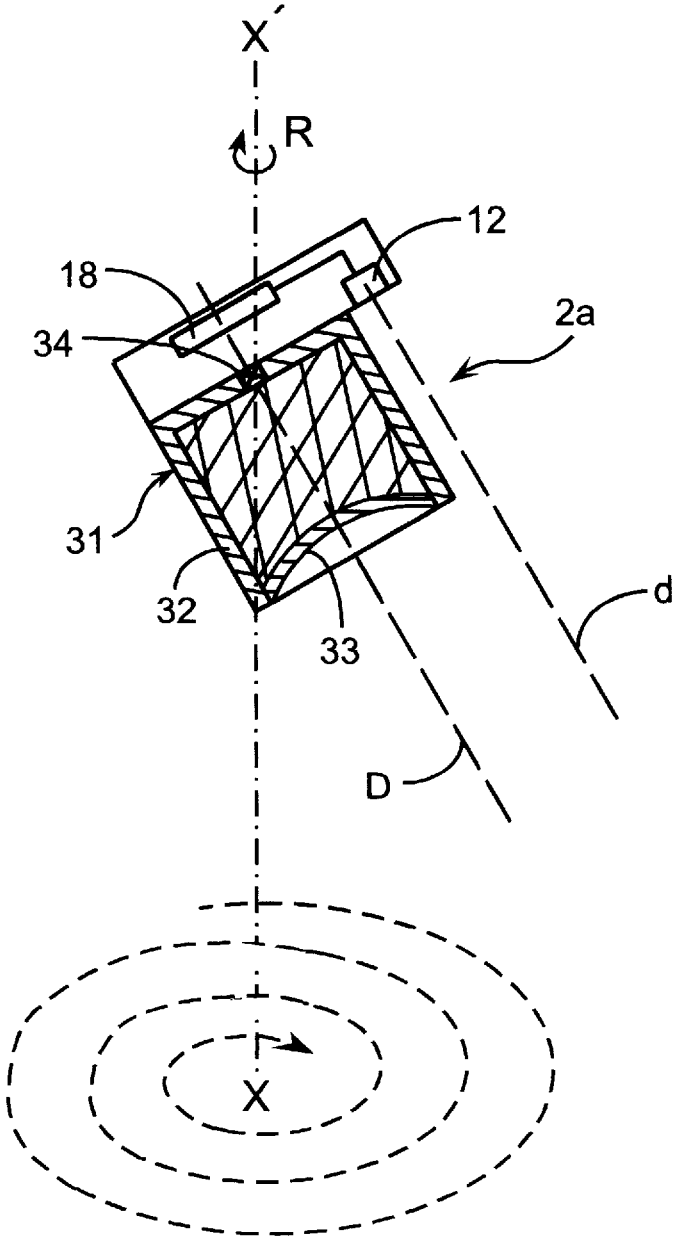
FIG. 7 shows a projectile of a forth embodiment of the invention.

FIG. 7 shows a sub-projectile 2*a* which is launched in known manner by a carrier (omitted) above a terrain segment, said carrier for instance being an artillery shell, a mortar projectile, a bomb or a cruise missile.

The sub-projectile 2*a* is decelerated at the time of its ejection by opening a parachute (omitted) being opened, whereby the sub-projectile also is oriented substantially vertically (XX') to the ground. The sub-projectile rotates at a speed R of about 15 rev/s about said axis XX'.

The sub-projectile 2*a* comprises an explosive, core-generating load 31. In known manner, such a load comprises an explosive charge 32 present in a case and clad by cladding 33.

In such a load, igniting the explosive charge 32 by means of a primer 34 deforms the cladding 33 which thereby is transformed into a projectile (or core) moving at high speed of about 2,000 m/s).

Such a load is designed to attack tanks, the core's aerodynamic stability and its accuracy allowing firing it at distances of about 200 m from the target.

A sub-projectile ejected from a carrier shell and fitted with a core-generating load is known in particular from the French patent 2,590,663, U.S. Pat. No. 4,807,533, European patent document 587,970, U.S. Pat. No. 4,858,532 and French patent 2,679,643 which provide design details on stabilizers and aerodynamic deceleration.

As in the embodiment described in relation to FIG. 4, the load's direction of action D slopes relative to the vertical XX' and the sub-projectile 2*a* rotates at a speed R about the axis XX'.

Again the sub-projectile is fitted with a fuse comprising a directional, laser-radiation detector 12 such as a photodiode evincing a direction of observation d which is close to the direction of action D of the load 31.

The fuse moreover comprises a computer-decoder 18 connected to the detector 12 and controlling ignition of the primer 34.

Because of the sub-projectile rotation during descent, the direction of observation d, as well as the direction of action D, sweep the ground in spirals.

The detector 12 picks up the radiation from a sighting laser (omitted) mounted on the ground, said radiation being reflected from a target.

The sighting device is actuated by a forward observer approximately 1 to 2 km from the sighted target.

When the detector 12 receives the target-reflected radiation, it ignites the load 31 which shall evince maximum efficacy because its direction of action D is pointing at the target.

Preferably again the laser beam transmitted by the sighting device shall be coded to shield the sub-projectile against countermeasures. The computer 18 will only fire the load 31 when the detector 12 receives the target-reflected coded signal.

Again the sub-projectile may be advantageously fitted with an altimeter precluding load ignition when the distance to ground is excessively large.

It is clear that the invention makes it possible to attack stopped or camouflaged targets. Moreover targets already inoperational need not be engaged.

The invention also offers very high flexibility in operation:

The foot soldier handling the sighting device may choose in relation to operational needs to sight an unarmored vehicle that cannot be attacked using known autonomous sub-projectiles fitted with tank-detection means.

The different embodiments described above relate to one or more sub-projectiles ejected above the target(s) by a carrier shell. These sub-projectiles obviously may be ejected from an artillery rocket, an airborne bomb or a cruise missile.

Moreover it is possible to design artillery or mortar shells similarly to the designs of the above-described sub-projectiles of FIGS. 2, 3 and 5, provided said shells be equipped with means to assume a substantially vertical orientation above the target:

They need only be fitted with aerodynamic decelerating means controlled by the shell's timing fuse.

Again projectiles or shells generally similar to those described above may be built of which however the XX' axis of the trajectory is substantially horizontal and above the ground. The operation will be the same as described above, projectile/shell rotation allowing to sweep the terrain by means of the detection direction d, and in this instance the sweep is implemented in parallel strips rather than spirally.

Such projectiles/shells may be finned artillery shells or missiles launched from a tank gun or by a light rocket launcher or sub-projectiles dropped over a terrain segment by cruise missiles.

We claim:

1. A projectile detonation system for instantaneously-capable remote detonation of conventionally launched non-guided projectiles, comprising:

a projectile comprising a carrier projectile and a detachable sub-projectile system which includes an explosive load;

said carrier projectile having detachment means for rotatably detaching said sub-projectile system from said projectile;

a remote sighting device, said remote sighting device being separate from said projectile;

said remote sighting device having means for transmitting a reflective radiation beam at a selected target; and said sub-projectile system having detection means for sweeping detection of a terrain as said sub-projectile system rotates in search of a reflected portion of said radiation beam that has reflected off said selected target; and detonation means to detonate the explosive load of said sub-projectile system when said sub-projectile is within an acceptable range of said target, the acceptable range being selected by said remote-sighting device.

2. The projectile detonation system according to claim 1 wherein said sub-projectile includes a fuse system comprising said detection means and said detonation means.

3. The projectile detonation system according to claim 2 wherein said detection means of said fuse system comprises a detector for a beam of reflected radiation; and said detonation means of said fuse system comprises a computer-decoder to receive the reflected radiation beam detected by said detector and detonate the explosive load of said sub-projectile when a preprogrammed detonation code is decoded by said computer-decoder.

4. The projectile system according to claim 3 wherein said detonation means of said fuse system includes an altimeter which the computer-decoder monitors for a specified altitude to initiate detonation.

5. The projectile detonation system according to claim 4, wherein said sub-projectile has a transmitter and said remote-sighting device has a receiver so that the transmitter of said sub-projectile can transmit information to the receiver of said remote-sighting device, and only after said sub-projectile transmits and said remote sighting device receives a signal indicating said sub-projectile is within an acceptable range is the explosive load of said sub-projectile detonated by receiving the reflected radiation transmitted by the remote sighting device, thereby reducing exposure to said remote-sighting device from detection.

6. The projectile detonation system according to claim 5, wherein the transmitter of said sub-projectile is activated by said computer-decoder.

7. The projectile detonation system according to claim 5, wherein the transmitter of said sub-system includes a timer.

8. The projectile detonation system according to claim 5 wherein activation of the transmitter of said sub-projectile includes the altimeter so that said computer-decoder will permit transmission by the transmitter at a predetermined altitude.

9. The projectile system of claim 3 wherein the explosive load of said sub-projectile comprises at least two different operational modes which are selectable by the fuse system.

10. The projectile system of claim 9 wherein the computer-decoder of said fuse system identifies and selects the operational mode from a signal in the reflective radiation beam that has reflected against said target.

11. The projectile system of claim 1 wherein at least two explosive loads are within said sub-projectile, with at least two detectors, one for each of said at least two explosive loads, said at least two detectors detecting radiation transmitted by the remote sighting device and reflected from said target, each of said detectors having a direction of detection that is substantially parallel to the direction of action of the respective explosive load.

12. The projectile system of claim 11 wherein the explosive load of said sub-projectile is a core-generating load.

13. The projectile system of claim 1 wherein said carrier projectile is a ballistic shell.

14. The projectile system of claim 1 wherein said carrier projectile is a bomb.

15. The projectile system of claim 1 wherein said carrier projectile is a straight-line projectile launchable by a light rocket launcher.

16. The projectile system of claim 1 wherein said carrier projectile is a straight-line projectile launchable by a tank gun.

17. The projectile system of claim 1 wherein said carrier projectile is an artillery shell.

18. The projectile system of claim 1 wherein said carrier projectile is a mortar.

19. The projectile system of claim 1, wherein the detonator means of said sub-projectile further comprises detonation-on-impact means for detonation of the explosive load of said sub-projectile without reception of the reflected radiation beam.

* * * * *